US009039791B2

(12) United States Patent
Peretolchin et al.

(10) Patent No.: US 9,039,791 B2
(45) Date of Patent: May 26, 2015

(54) USE OF A REACTION PRODUCT OF CARBOXYLIC ACIDS WITH ALIPHATIC POLYAMINES FOR IMPROVING OR BOOSTING THE SEPARATION OF WATER FROM FUEL OILS

(71) Applicant: BASF SE, Ludwigshafen (DE)

(72) Inventors: Maxim Peretolchin, Lambrecht (DE); Guenter Oetter, Frankenthal (DE); Harald Boehnke, Mannheim (DE); Markus Hansch, Speyer (DE); Ludwig Voelkel, Limburgerhof (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/898,766

(22) Filed: May 21, 2013

(65) Prior Publication Data

US 2013/0312318 A1 Nov. 28, 2013

Related U.S. Application Data

(60) Provisional application No. 61/651,574, filed on May 25, 2012.

(51) Int. Cl.

| | |
|---|---|
| ***C10L 1/22*** | (2006.01) |
| ***C10L 10/18*** | (2006.01) |
| ***C10L 1/222*** | (2006.01) |
| ***C10L 1/223*** | (2006.01) |
| ***C10L 1/224*** | (2006.01) |
| ***C10L 1/2383*** | (2006.01) |

(52) U.S. Cl.

CPC ..... *C10L 10/18* (2013.01); *C10L 1/221* (2013.01); *C10L 1/2222* (2013.01); *C10L 1/223* (2013.01); *C10L 1/224* (2013.01); *C10L 1/2383* (2013.01); *C10L 2200/0476* (2013.01); *C10L 2270/026* (2013.01)

(58) Field of Classification Search

CPC ..... C10L 10/18; C10L 1/221; C10L 1/2222; C10L 1/223; C10L 1/224; C10L 1/2383; C10L 2200/0476; C10L 2270/026

USPC ..... 44/331, 334, 386, 388, 450, 418

See application file for complete search history.

(56) References Cited

U.S. PATENT DOCUMENTS

| | | | | |
|---|---|---|---|---|
| 2,225,189 | A | 12/1940 | Wayne | |
| 4,849,572 | A | 7/1989 | Chen et al. | |
| 5,039,388 | A | 8/1991 | Miyashita et al. | |
| 5,958,089 | A * | 9/1999 | Dillworth et al. | 44/347 |
| 8,177,865 | B2 * | 5/2012 | Shea et al. | 44/354 |
| 2011/0315107 | A1 | 12/2011 | Grabarse et al. | |
| 2012/0010112 | A1 | 1/2012 | Grabarse et al. | |
| 2012/0137573 | A1 | 6/2012 | Völkel et al. | |
| 2012/0144731 | A1 | 6/2012 | Böhnke | |
| 2012/0149617 | A1 | 6/2012 | Lange et al. | |
| 2012/0222348 | A1 | 9/2012 | Böhnke | |
| 2013/0133243 | A1 | 5/2013 | Röger-Göpfert et al. | |

FOREIGN PATENT DOCUMENTS

| | | | |
|---|---|---|---|
| CN | 102277212 | A | 12/2011 |
| DE | 1 645 705 | | 7/1970 |
| EP | 0 074 077 | A2 | 3/1983 |
| EP | 0 383 550 | A2 | 8/1990 |
| WO | WO 2008/092809 | A1 | 8/2008 |
| WO | WO 2012/004300 | A1 | 1/2012 |

OTHER PUBLICATIONS

U.S. Appl. No. 13/712,297, filed Dec. 12, 2012, Hansch, et al.
U.S. Appl. No. 13/781,929, filed Mar. 1, 2013, Strittmatter, et al.
U.S. Appl. No. 13/761,644, filed Feb. 7, 2013, Peretolchin, et al.
U.S. Appl. No. 13/668,985, filed Nov. 5, 2012, Hansch, et al.
U.S. Appl. No. 13/783,708, filed Mar. 4, 2013, Strittmatter, et al.
U.S. Appl. No. 13/866,291, filed Apr. 19, 2013, Boehnke.
International Search Report and Written Opinion of the International Searching Authority issued Aug. 1, 2013, in PCT/EP2013/059052.

* cited by examiner

*Primary Examiner* — Cephia D Toomer
(74) *Attorney, Agent, or Firm* — Oblon, McClelland, Maier & Neustadt, L.L.P.

(57) ABSTRACT

Use of a reaction product of saturated or unsaturated aliphatic mono- or polycarboxylic acids with aliphatic polyamines for improving or boosting the separation of water from fuel oils which comprise additives with detergent action. A Fuel additive concentrate comprising the said reaction product, certain additives with detergent action and optionally dehazers, cetane number improvers and solvents or diluents.

13 Claims, No Drawings

USE OF A REACTION PRODUCT OF CARBOXYLIC ACIDS WITH ALIPHATIC POLYAMINES FOR IMPROVING OR BOOSTING THE SEPARATION OF WATER FROM FUEL OILS

CROSS REFERENCE TO RELATED APPLICATION

This application claims priority to U.S. Provisional Patent Application No. 61/651,574, filed on May 25, 2012, herein incorporated in its entirety by reference.

The present invention relates to the use of a reaction product (RP) of (A) at least one saturated or unsaturated aliphatic mono- or polycarboxylic acid with 10 to 200 carbon atoms or an anhydride thereof with (B) at least one aliphatic polyamine comprising 2 to 10 nitrogen atoms and 0 to 2 hydroxyl groups exhibiting at least one primary or secondary amino group, for improving or boosting the separation of water from fuel oils which comprise (C) at least one additive with detergent action.

Fuel oils such as middle distillates, e.g. diesel fuels, heating oils or jet fuels, often contain small amounts of water, typically in the region of from several parts per millions up to several percent by weight, due to condensation of water into the cold fuel oils and into the storage tanks and pipelines during transport and storage. This amount of water partly separates as a layer at the bottom of the storage tank and partly is emulsified in the fuel oil. The presence of water is undesired as it can cause severe problems on transport and on use in combustion engines and heating devices.

German laid open Patent Application 1 645 705 (1) discloses to use of amides of carboxylic acids to dehaze hydrocarbon mixtures, e.g. heating oil and diesel fuel. The said amides are for example prepared from di-, tri- and polyamines like ethylene-diamine, propylenediamine, diethylenetriamine, tetraethylenepentamine, dipropylene-triamine, methyldipropylenetriamine, diaminobutane or polyamylenepolyamine, and higher fatty acids, e.g. oleic acid, however, without giving any stoichiometric ratios for preparation. No hint is given to any possible interactions or synergistic interactions of the said amides with further middle distillate performance additives such as additives with detergent action or further additives with dehazing action. As the teaching of (1) refers to dehaze the hydrocarbon mixtures, i.e. to clear them up by generating hydrocarbon-water-emulsions, such technical solution may only work with relatively small amounts of water; this method will fail with larger amounts of water.

Chinese Patent Application 102277212 A (2) relates to a diesel performance additive which is a mixture of tall oil fatty acids, an oleic acid amide and a naphthenic acid imidazoline. The said three-component additive is recommended as an emulsifying agent to dehaze and clear up diesel fuels. In an example, a corresponding oleic acid amide is prepared by reaction of oleic acid with diethylenetriamine in the stoichiometric ratio of 1:1.75. Similar to (1) above, no hint is given to any possible interactions or synergistic interactions of the said amides with further middle distillate performance additives such as additives with detergent action or further additives with dehazing action. As the teaching of (2) also refers to dehaze the diesel fuels, i.e. to clear them up by generating hydrocarbon-water-emulsions, such technical solution may only work with relatively small amounts of water; this method will fail with larger amounts of water.

"Dehazing" as referred to in the cited documents above and as generally understood in the art shall mean clearing up water-containing hydrocarbons or diesel fuels, respectively, by generating clear hydrocarbon-water-emulsions ("emulsification") and shall not include separating water in separate phase ("demulsification"), thus enabling to remove the water by phase separation.

There is a need to separate also larger amounts of water from fuel oils using suitable additive which are capable of completely or practically completely remove the water from the fuel oils. Such additives should interact with other performance additives present in the fuel oils in an advantageous way. Especially, the tendency of modern additives with detergent action to support the undesired formation and stabilization of fuel oil-water-emulsions should be counteracted.

Accordingly, the above defined use of a reaction product (RP) for improving or boosting the separation of water from fuel oils comprising one or more additives with detergent action has been found.

According to the present invention, water present in the fuel oils is separated as a layer at the bottom of a separation device and, thereafter, can be easily removed. The water content in fuel oils which can be removed in this way is normally from about 200 ppm by weight to about 10% by weight, especially from about 1000 ppm by weight to about 5% by weight. Emulsifying water in the fuel oil by interaction with (RP) occurs only to a negligible minor amount.

According to the present invention, the reaction product (RP) improves and completes the phase separation of water from the fuel oils which occurs with larger amounts of water present in the fuel oils already without any performance additive but in an incomplete way. Furthermore, (RP) boosts the phase separation of water from fuel oils if other surface active additives, especially certain commercially available dehazers, are already present in the fuel oils. Astonishingly, the interaction between (RP) and certain commercially available dehazers which are by nature emulsifying additives also leads to an improved demulsifying and water phase separating action.

Reactant (A) for producing (RP) is a saturated or unsaturated aliphatic mono- or polycarboxylic acid with 10 to 200, preferably 14 to 200, more preferably 16 to 170, most preferably 18 to 100 carbon atoms, or a mixture of such acids. The carboxylic acids for (A) exhibit one or more, e.g. two or three, linear or branched alkyl or alkenyl groups of each at least 10, preferably at least 14, more preferably at least 16, most preferably at least 18 carbon atoms. The carboxylic acids for (A) normally do not comprise cyclic structural units like cyclopentylene or cyclohexylene groups.

The carboxylic acids for (A) may comprise monocarboxylic acids or their anhydrides, especially saturated or unsaturated long-chain fatty acids, e.g. lauric acid, myristic acid, palmitic acid, stearic acid, oleic acid, linoleic acid, linolenic acid and elaidic acid. Oleic acid is especially preferred.

Furthermore, the carboxylic acids for (A) may comprise polycarboxylic acids, especially dicarboxylic acids, or their anhydrides which exhibit long-chain alkylene or alkenylene bridging groups between the carboxylic groups with at least 8, preferably at least 12, more preferably at least 14, most preferably at least 16, or one or more side-chain linear or branched alkyl or alkenyl radicals with at least 10, preferably at least 14, more preferably at least 16, most preferably at least 18 carbon atoms. Suitable side-chain branched alkyl and alkenyl radicals are for example polyisobutyl- and polyisobutenyl radicals. A typical example for such a dicarboxylic acid is polyisobutenylsuccinic acid and its anhydride with 35 to 100, especially 65 to 80, e.g. about 70 carbon atoms in the polyisobut(en)yl radical.

In a preferred embodiment of the present invention, reactant (A) comprises at least one saturated or unsaturated aliphatic monocarboxylic acid with 14 to 200, preferably 16 to 170, more preferably 18 to 100 carbon atoms.

Reactant (B) for producing (RP) is a linear or branched aliphatic polyamine comprising 2 to 10 nitrogen atoms and 0 to 2 hydroxyl groups exhibiting at least one primary or secondary amino group. Preferably, (B) comprises at least two amino groups which are primary or secondary amino groups. If case of additionally carrying 1 or 2 hydroxyl groups, the aliphatic polyamines for (B) are typically polyaminoalcohols of general formulas HO—$(X—NH)_p$—H or HO—$(Y—NH)_q$—Y—OH, in which p and q independently from each other stand for a number of from 2 to 10 and X and Y independently from each other represent 1,2-ethylene, 1,3-propylene, 1,2-propylene or 1,4-butylene.

In case of absence of any hydroxyl group, (B) comprises especially polyalkyleneamines in which the nitrogen atoms are bridged by linear or branched alkylene groups with each 1 to 12, preferably 2 to 8 carbon atoms. The aliphatic polyamines for (B) normally do not comprise cyclic bridging units like cyclopentylene or cyclohexylene groups. Tertiary amino groups may also be present.

In a preferred embodiment of the present invention, reactant (B) comprises at least one polyalkyleneamine of general formula $H_2N$-$(A-NH)_n$—H in which A represents 1,2-ethylene, 1,3-propylene, 1,2-propylene or 1,4-butylene and n stands for a number of from 1 to 5. Typical examples for such polyalkyleneamines are ethylene-1,2-diamine, propylene-1,3-diamine, propylene-1,2-diamine, diethylenetriamine, triethylentetramine, tetraethylenepentamine, pentaethylenehexamine, dipropylenetriamine, N-methyldipropylenetriamine and butylene-1,4-diamine.

The reaction product (RP) of the carboxylic acids (A) and the aliphatic polyamines (B) may be the corresponding ammonium salts, the corresponding amides or imides, the corresponding mixed ammonium salts/amides or imides, and/or follow-up products of the said amides or imides such as products generated by intramolecular or intermolecular cyclization (especially when higher temperatures are applied during the synthesis), e.g. products with imidazoline structural units formed by ring cleavage between a carbonyl atom of an amide unit and a secondary amine group. As RP is usually a technical product it is in most cases a mixture of different species of the above amides or imides, mixed ammonium salts/amides or imides, and/or follow-up products of the said amides or imides.

In a preferred embodiment of the present invention, reactant (B) exhibits at least two amino groups which are primary or secondary amino groups, and reactants (A) and (B) are reacted in a molar ratio of from 1.1:1 to 7:1, preferably of from 1.5:1 to 6:1, more preferably of from 1.7:1 to 5:1, most preferably of from 1.8:1 to 4:1. In such cases, (B) may exhibit 2 primary amino group and 0, 1, 2, 3 or 4 secondary amino groups. A suitable reaction product (RP) is made for example from oleic acid and diethylenetriamine in a molar ratio of 1.83:1 exhibiting a structure with an imidazoline ring for its main component.

Additives with detergent action of component (C) refer, in the context of the present invention, to those compounds whose effect in an internal combustion engine or in a heating device, especially a diesel engine, consists predominantly or at least essentially of eliminating and/or preventing deposits. The detergents are preferably amphiphilic substances which have at least one hydrophobic hydrocarbyl radical having a number-average molecular weight ($M_n$) of 85 to 20.000, especially of 300 to 5000, and in particular of 500 to 2500, and at least one polar moiety.

In a preferred embodiment of the present invention, the fuel oils comprise at least one additive component with detergent action (C) which is selected from (i) compounds with moieties derived from succinic anhydride and having hydroxyl and/or amino and/or amido and/or imido groups;

(ii) nitrogen compounds quaternized in the presence of an acid or in an acid-free manner, obtainable by addition of a compound comprising at least one oxygen- or nitrogen-containing group reactive with an anhydride and additionally at least one quaternizable amino group onto a polycarboxylic anhydride compound and subsequent quaterniza-tion;

(iii) polytetrahydrobenzoxazines and bistetrahydrobenzoxazines.

Additives (i) comprising moieties deriving from succinic anhydride and having hydroxyl and/or amino and/or amido and/or imido groups are preferably corresponding derivatives of polyisobutenylsuccinic anhydride, which are obtainable by reaction of conventional or high-reactivity polyisobutene with $M_n$=300 to 5000, in particular with $M_n$=500 to 2500, with maleic anhydride by a thermal route or via the chlorinated polyisobutene. Of particular interest in this context are derivatives with aliphatic polyamines such as ethylenediamine, diethylenetriamine, triethylenetetramine or tetraethylenepentamine. The moieties with hydroxyl and/or amino and/or amido and/or imido groups are for example carboxylic acid groups, acid amides, acid amides of di- or polyamines, which, as well as the amide function, also have free amine groups, succinic acid derivatives with an acid and an amide function, carboxyimides with monoamines, carboxyimides with di- or polyamines, which, as well as the imide function, also have free amine groups, and diimides, which are formed by the reaction of di- or polyamines with two succinic acid derivatives. Such fuel additives are described especially in U.S. Pat. No. 4,849,572.

Nitrogen compounds quaternized in the presence of an acid or in an acid-free manner according to the above group (ii) are obtainable by addition of a compound which comprises at least one oxygen- or nitrogen-containing group reactive with an anhydride and additionally at least one quaternizable amino group onto a polycarboxylic anhydride compound and subsequent quaternization, especially with an epoxide, e.g. styrene or propylene oxide, in the absence of free acid, as described in WO 2012/004300, or with a carboxylic ester, e.g. dimethyl oxalate or methyl salicylate. Suitable compounds having at least one oxygen- or nitrogen-containing group reactive with anhydride and additionally at least one quaternizable amino group are especially polyamines having at least one primary or secondary amino group and at least one tertiary amino group. Useful polycarboxylic anhydrides are especially dicarboxylic acids such as succinic acid, having a relatively long-chain hydrocarbyl substituent, preferably having a number-average molecular weight $M_n$ for the hydrocarbyl substituent of 200 to 10.000, in particular of 350 to 5000. Such a quaternized nitrogen compound is, for example, the reaction product, obtained at 40° C., of polyisobutenylsuccinic anhydride, in which the polyisobutenyl radical typically has an $M_n$ of 1000, with 3-(dimethylamino)propylamine, which constitutes a polyisobutenylsuccinic monoamide and which is subsequently quaternized with styrene oxide or propylene oxide in the absence of free acid at 70° C.

Polytetrahydrobenzoxazines and bistetrahydrobenzoxazines according to the above group (iii) are described in EP patent application 10 194 307.4. Such polytetrahydro-benzoxazines and bistetrahydrobenzoxazines are obtainable by successively reacting, in a first reaction step, a $C_1$- to $C_{20}$-alkylenediamine having two primary amino functions, e.g. 1,2-ethylenediamine, with a $C_1$- to $C_{12}$-aldehyde, e.g. formaldehyde, and a $C_1$- to $C_8$-alkanol at a temperature of 20 to 80° C. with elimination and removal of water, where both the aldehyde and the alcohol can each be used in more than twice the molar amount, especially in each case in 4 times the molar amount, relative to the diamine, in a second reaction step reacting the condensation product thus obtained with a phenol which bears at least one long-chain substituent having 6 to 3000 carbon atoms, e.g. a tert-octyl, n-nonyl, n-dodecyl or polyisobutyl radical having an $M_n$ of 1000, in a stoichiometric ratio relative to the originally used alkylenediamine of 1.2:1 to 3:1 at a temperature of 30 to 120° C. and optionally in a third reaction step heating the bistetrahydrobenzoxazine thus obtained to a temperature of 125 to 280° C. for at least 10 minutes.

Within the scope of the present invention, reaction product (RP) is preferably used together with quarternized nitrogen compounds (ii) for component (C).

Furthermore, the present reaction product (RP) and the at least one additive with detergent action for component (C) exhibit superior performance—even in the sense of synergism—in improving and/or boosting the separation of water from fuel oils when applied together with at least one dehazer exhibiting emulsifying action on its own when used alone as additive component (D) selected from (iv) alkoxylation copolymers of ethylene oxide, propylene oxide, butylene oxide, styrene oxide and/or other oxides, e.g. epoxy based resins;

(v) alkoxylated phenol formaldehyde resins.

Dehazer components (iv) and (v) are normally commercially available products, e.g. the dehazer products available from Baker Petrolite under the brand name of Tolad® such as Tolad® 2898, 9360K, 9348, 9352K or 9327.

In a further preferred embodiment of the present invention, the fuel oils additionally comprise as additive component (E) at least on cetane number improver. Cetane number improvers used are typically organic nitrates. Such organic nitrates are especially nitrate esters of unsubstituted or substituted aliphatic or cycloaliphatic alcohols, usually having up to about 10, in particular having 2 to 10 carbon atoms. The alkyl group in these nitrate esters may be linear or branched, and saturated or unsaturated. Typical examples of such nitrate esters are methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, sec-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate and isopropylcyclohexyl nitrate and also branched decyl nitrates of the formula $R^1R^2CH—CH_2—)O—NO_2$ in which $R^1$ is an n-propyl or isopropyl radical and $R^2$ is a linear or branched alkyl radical having 5 carbon atoms, as described in WO 2008/092809. Additionally suitable are, for example, nitrate esters of alkoxy-substituted aliphatic alcohols such as 2-ethoxyethyl nitrate, 2-(2-ethoxy-ethoxy) ethyl nitrate, 1-methoxypropyl nitrate or 4-ethoxybutyl nitrate. Additionally suitable are also diol nitrates such as 1,6-hexamethylene dinitrate. Among the cetane number improver classes mentioned, preference is given to primary amyl nitrates, primary hexyl nitrates, octyl nitrates and mixtures thereof. Most preferably, 2-ethylhexyl nitrate is present in the fuel oils as the sole cetane number improver or in a mixture with other cetane number improvers.

In the context of the present invention, fuel oils means prefereably middle distillate fuels, especially diesel fuels. However, heating oils, jet fuels and kerosene shall also be encompassed. Diesel fuels or middle distillate fuels are typically mineral oil raffinates which generally have a boiling range from 100 to 400° C. These are usually distillates having a 95% point up to 360° C. or even higher. However, these may also be what is called "ultra low sulfur diesel" or "city diesel", characterized by a 95% point of, for example, not more than 345° C. and a sulfur content of not more than 0.005% by weight, or by a 95% point of, for example, 285° C. and a sulfur content of not more than 0.001% by weight. In addition to the diesel fuels obtainable by refining, the main constituents of which are relatively long-chain paraffins, those obtainable in a synthetic way by coal gasification or gas liquefaction ["gas to liquid" (GTL) fuels] are suitable, too. Also suitable are mixtures of the aforementioned diesel fuels with renewable fuels (biofuel oils) such as biodiesel or bioethanol. Of particular interest at present are diesel fuels with low sulfur content, i.e. with a sulfur content of less than 0.05% by weight, preferably of less than 0.02% by weight, particularly of less than 0.005% by weight and especially of less than 0.001% by weight of sulfur.

In a preferred embodiment, the instant reaction product (RP) is used together with the aforementioned components (C), (D) and, if desired (E), in fuel oils which consist (a) to an extent of 0.1 to 100% by weight, preferably to an extent of 0.1 to less than 100% by weight, especially to an extent of 10 to 95% by weight and in particular to an extent of 30 to 90% by weight, of at least one biofuel oil based on fatty acid esters, and (b) to an extent of 0 to 99.9% by weight, preferably to an extent of more than 0 to 99.9% by weight, especially to an extent of 5 to 90% by weight, and in particular to an extent of 10 to 70% by weight, of middle distillates of fossil origin and/or of synthetic origin and/or of vegetable and/or animal origin, which are essentially hydrocarbon mixtures and are free of fatty acid esters.

The instant reaction product (RP) can also be used together with the aforementioned components (C), (D) and, if desired (E), in fuel oils which consist exclusively of middle distillates of fossil origin and/or of synthetic origin and/or of vegetable and/or animal origin, which are essentially hydrocarbon mixtures and are free of fatty acid esters.

Fuel oil component (a) is usually also referred to as "biodiesel". This preferably comprises essentially alkyl esters of fatty acids which derive from vegetable and/or animal oils and/or fats. Alkyl esters typically refer to lower alkyl esters, especially $C_1$- to $C_4$-alkyl esters, which are obtainable by transesterifying the glycerides which occur in vegetable and/or animal oils and/or fats, especially triglycerides, by means of lower alcohols, for example, ethanol, n-propanol, isopropanol, n-butanol, isobutanol, secbutanol, tert-butanol or especially methanol ("FAME").

Examples of vegetable oils which can be converted to corresponding alkyl esters and can thus serve as the basis of biodiesel are castor oil, olive oil, peanut oil, palm kernel oil, coconut oil, mustard oil, cottonseed oil, and especially sunflower oil, palm oil, soybean oil and rapeseed oil. Further examples include oils which can be obtained from wheat, jute, sesame and shea tree nut; it is additionally also possible to use arachis oil, jatropha oil and linseed oil. The extraction of these oils and the conversion thereof to the alkyl esters are known from the prior art or can be inferred therefrom.

It is also possible to convert already used vegetable oils, for example used deep fat fryer oil, optionally after appropriate cleaning, to alkyl esters, and thus for them to serve as the basis of biodiesel.

Vegetable fats can in principle likewise be used as a source for biodiesel, but play a minor role.

Examples of animal oils and fats which can be converted to corresponding alkyl esters and can thus serve as the basis of biodiesel are fish oil, bovine tallow, porcine tallow and similar fats and oils obtained as wastes in the slaughter or utilization of farm animals or wild animals.

The parent saturated or unsaturated fatty acids of said vegetable and/or animal oils and/or fats, which usually have 12 to 22 carbon atoms and may bear an additional functional group such as hydroxyl groups, and which occur in the alkyl esters, are especially lauric acid, myristic acid, palmitic acid, stearic acid, oleic acid, linoleic acid, linolenic acid, elaidic acid, erucic acid and/or ricinoleic acid.

Typical lower alkyl esters based on vegetable and/or animal oils and/or fats, which find use as biodiesel or biodiesel components, are, for example, sunflower methyl ester, palm oil methyl ester ("PME"), soybean oil methyl ester ("SME") and especially rapeseed oil methyl ester ("RME").

However, it is also possible to use the monoglycerides, diglycerides and especially triglycerides themselves, for example castor oil, or mixtures of such glycerides, as biodiesel or components for biodiesel.

In the context of the present invention, the fuel oil component (b) shall be understood to mean the abovementioned middle distillate fuels, especially diesel fuels, especially those which boil in the range from 120 to 450° C.

In a further preferred embodiment, the instant reaction product (RP) is used together with the aforementioned components (C), (D) and, if desired (E), in fuel oils which have at least one of the following properties:

(α) a sulfur content of less than 50 mg/kg (corresponding to 0.005% by weight), especially less than 10 mg/kg (corresponding to 0.001% by weight);

(β) a maximum content of 8% by weight of polycyclic aromatic hydrocarbons;

(γ) a 95% distillation point (vol/vol) at not more than 360° C.

Polycyclic aromatic hydrocarbons in (β) shall be understood to mean polyaromatic hydrocarbons according to standard EN 12916. They are determined according to this standard.

The fuel oils comprise said reaction product (RP) in the context of the present invention generally in an amount of from 1 to 1000 ppm by weight, preferably of from 5 to 500 ppm by weight, more preferably of from 3 to 300 ppm by weight, most preferably of from 5 to 200 ppm by weight, for example of from 10 to 100 ppm by weight.

The additive with detergent action (C) or a mixture of a plurality of such additives with detergent action is present in the fuel oils typically in an amount of from 10 to 2000 ppm by weight, preferably of from 20 to 1000 ppm by weight, more preferably of from 50 to 500 ppm by weight, most preferably of from 30 to 250 ppm by weight, for example of from 50 to 150 ppm by weight.

One or more dehazers as additive component (D), if any, are present in the fuel oils generally in an amount of from 0.5 to 100 ppm by weight, preferably of from 1 to 50 ppm by weight, more preferably of from 1.5 to 40 ppm by weight, most preferably of from 2 to 30 ppm by weight, for example of from 3 to 20 ppm by weight.

The cetane number improver (E) or a mixture of a plurality of cetane number improvers is present in the fuel oils normally in an amount of form 10 to 10.000 ppm by weight, preferably of from 20 to 5000 ppm by weight, more preferably of from 50 to 2500 ppm by weight, most preferably of from 100 to 1000 ppm by weight, for example of from 150 to 500 ppm by weight.

Subject matter of the present invention is also a fuel additive concentrate suitable for use in fuel oils, especially in diesel fuel, comprising (RP) 0.01 to 40% by weight, preferably 0.05 to 20% by weight, more preferably 0.1 to 10% by weight, of a reaction product of (A) at least one saturated or unsaturated aliphatic mono- or polycarboxylic acid with 10 to 200 carbon atoms or an anhydride thereof with (B) at least one aliphatic polyamine comprising 2 to 10 nitrogen atoms and 0 to 2 hydroxyl groups exhibiting at least one primary or secondary amino group;

(C) 5 to 40% by weight, preferably 10 to 35% by weight, more preferably 15 to 30% by weight, of at least one additive with detergent action selected from (i) compounds with moieties derived from succinic anhydride and having hydroxyl and/or amino and/or amido and/or imido groups;

(ii) nitrogen compounds quaternized in the presence of an acid or in an acid-free manner, obtainable by addition of a compound comprising at least one oxygen- or nitrogen-containing group reactive with an anhydride and additionally at least one quaternizable amino group onto a polycarboxylic anhydride compound and subsequent quaternization (iii) polytetrahydrobenzoxazines and bistetrahydrobenzoxazines;

(D) 0 to 5% by weight, preferably 0.01 to 5 by weight, more preferably 0.02 to 3.5% by weight, most preferably 0.05 to 2% by weight, of at least one dehazer selected from (iv) alkoxylation copolymers of ethylene oxide, propylene oxide, butylene oxide, styrene oxide and/or other oxides, e.g. epoxy based resins (v) alkoxylated phenol formaldehyde resins;

(E) 0 to 75% by weight, preferably 5 to 75% by weight, more preferably 10 to 70% by weight, of at least one cetane number improver;

(F) 0 to 50% by weight, preferably 5 to 50% by weight, more preferably 10 to 40% by weight, of at least one solvent or diluent.

In each case, the sum of components (RP), (C), (D), (E) and (F) results in 100%.

Said fuel oils such as diesel fuels, or said mixtures of biofuel oils and middle distillates of fossil, synthetic, vegetable or animal origin, may comprise, in addition to reaction product (RP) and components (C) and, if any (D) and (E), as coadditives further customary additive components in amounts customary therefor, especially cold flow improvers, corrosion inhibitors, further demulsifiers, antifoams, antioxidants and stabilizers, metal deactivators, antistats, lubricity improvers, dyes (markers) and/or diluents and solvents. Said fuel additive concentrates may also comprise certain of the above coadditives in amounts customary therefor, e.g. corrosion improvers, further demulsifiers, antifoams, antioxidants and stabilizers, metal deactivators, antistats and lubricity improvers.

Cold flow improvers suitable as further coadditives are, for example, copolymers of ethylene with at least one further unsaturated monomer, in particular ethylene-vinyl acetate copolymers.

Corrosion inhibitors suitable as further coadditives are, for example, succinic esters, in particular with polyols, fatty acid derivatives, for example oleic esters, oligomerized fatty acids and substituted ethanolamines.

Further demulsifiers suitable as further coadditives are, for example, the alkali metal and alkaline earth metal salts of alkyl-substituted phenol- and naphthalenesulfonates and the alkali metal and alkaline earth metal salts of fatty acid, and also alcohol alkoxylates, e.g. alcohol ethoxylates, phenol alkoxylates, e.g. tert-butylphenol ethoxylates or tert-pentylphenol ethoxylates, fatty acids, alkylphenols, condensation products of ethylene oxide and propylene oxide, e.g. ethylene oxide-propylene oxide block copolymers, polyethyleneimines and polysiloxanes.

Antifoams suitable as further coadditives are, for example, polyether-modified polysiloxanes.

Antioxidants suitable as further coadditives are, for example, substituted phenols, e.g. 2,6-di-tert-butylphenol and 2,6-di-tert-butyl-3-methylphenol, and also phenylenediamines, e.g. N,N'-di-sec-butyl-p-phenylenediamine. Metal deactivators suitable as further coadditives are, for example, salicylic acid derivatives, e.g. N,N'-disalicylidene-1,2-propanediamine.

A lubricity improver suitable as a further coadditive is, for example, glyceryl monooleate.

Suitable solvents and diluents, especially for diesel performance packages, are, for example, nonpolar organic solvents, especially aromatic and aliphatic hydrocarbons, for example toluene, xylenes, "white spirit" and the technical solvent mixtures of the designations Shellsol® (manufactured by Royal Dutch/Shell Group), Exxol® (manufactured by ExxonMobil) and Solvent Naphtha. Also useful here, especially in a blend with the nonpolar organic solvents mentioned, are polar organic solvents, in particular alcohols such as 2-ethylhexanol, decanol and isotridecanol.

The examples which follow are intended to illustrate the present invention without restricting it.

EXAMPLES

For evaluating the capability of the present reaction product (RP) of separating water from diesel fuels containing an additive with detergent action, the corresponding standard test method according to ASTM D 1094 was applied. For this test, a glass cylinder was filled with 20 ml of water buffer and 80 ml of the diesel fuel and then shaken for 2 minutes. After the emulsion generated has been allowed to settle for a fixed period of time (5 minutes), the quantities (volumes) of the water-diesel interphase ("$P_I$"), the diesel phase ("$P_D$") and the water phase ("$P_W$") as well as the amount of water which had remained emulsified ("$W_E$") and also the time for emulsion remaining and for full water separation were determined.

The test was carried through in a commercially available diesel fuel composed of 100% of middle distillates of fossil origin ("DF1") an in a commercially available biodiesel containing diesel fuel composed of 90% by weight of middle distillates of fossil origin and 10% by weight of FAME ("DF2").

Three different reaction products (RP) were used: RP1 was the reaction product made from oleic acid and diethylenetriamine in a molar ratio of 1.83:1 exhibiting a structure with an imidazoline ring for its main component. RP2 was the reaction product made from oleic acid and tetraethylenepentamine in a molar ratio of 2.0:1. RP 3 was the reaction product made from oleic acid and tetraethylenepentamine in a molar ratio of 3.5:1. The concentration of said compounds RP1, RP2 and RP3 in the 80 ml DF1 and DF2, respectively, is given in the table below, when present.

The additive with detergent action (C) used was a compound of group (ii), i.e. the reaction product, obtained at 40° C., of polyisobutenylsuccinic anhydride, in which the polyisobutenyl radical has an $M_n$ of 1000, with 3-(dimethylamino) propylamine, which constitutes a polyisobutenylsuccinic monoamide and which is subsequently quarternized with propylene oxide in the absence of free acid at 70° C. The concentration of said compound C(ii) in the 80 ml DF1 and DF2, respectively, is given in the table below, when present.

The dehazer (D) used was a compound of group (v), i.e. a commercially available product available from Baker Petrolite under the name of Tolad® 2898. The concentration of said compound D(v) in the 80 ml DF1 and DF2, respectively, is given in the table below, when present.

The following table shows the results of the determinations:

| Example | Additives used with concentration [wt.-ppm] | Fuel |
|---|---|---|
| 1a | None | DF1 |
| 1b | C(ii) 70 ppm + D(v) 6 ppm | DF1 |
| 1c | C(ii) 70 ppm + D(v) 6 ppm + RP1 80 ppm | DF1 |
| 2a | None | DF1 |
| 2b | C(ii) 24 ppm + D(v) 3 ppm | DF1 |
| 2c | C(ii) 24 ppm + D(v) 3 ppm + RP2 40 ppm | DF1 |
| 3a | None | DF1 |
| 3b | C(ii) 24 ppm + D(v) 3 ppm | DF1 |
| 3c | C(ii) 24 ppm + D(v) 3 ppm + RP3 20 ppm | DF1 |
| 4a | None | DF2 |
| 4b | C(ii) 70 ppm + D(v) 6 ppm | DF2 |
| 4c | C(ii) 70 ppm + D(v) 6 ppm + RP1 80 ppm | DF2 |

| | Evaluation: | | | | | |
|---|---|---|---|---|---|---|
| | After 5 minutes [ml] | | | | 5 ml emulsion remaining | full (20 ml) water |
| Example | $P_I$ | $P_D$ | $P_W$ | $W_E$ | after [min] | separation after [min] |
| 1a | 4 | 3 | 3 | 14 | 11 | 40 |
| 1b | 4 | 3 | 3 | 20 | more than 60 | more than 60 |
| 1c | 4 | 3 | 3 | 6 | 6 | 9.5 |
| 2a | 1 | 2 | 1 | 0 | 0.5 | 1.5 |
| 2b | 4 | 3 | 3 | 20 | 11.5 | 13.5 |
| 2c | 4 | 3 | 3 | 3 | 4.5 | 6 |
| 3a | 1 | 2 | 1 | 0 | 0.5 | 1.5 |
| 3b | 4 | 3 | 3 | 20 | 11.5 | 13.5 |
| 3c | 4 | 3 | 3 | 3 | 4.5 | 6 |
| 4a | 4 | 3 | 3 | 20 | 240 | more than 1440 |
| 4b | 4 | 3 | 3 | 6 | 7 | 19 |
| 4c | 4 | 3 | 3 | 4 | 4 | 11 |

The invention claimed is:

1. A method for improving or boosting separation of water from a fuel oil comprising a first additive having detergent action and water, the method comprising:

separating water from the fuel oil by combining the fuel oil with a reaction product, wherein the reaction product comprises a saturated or unsaturated aliphatic mono- or polycarboxylic acid having from 10 to 200 carbon atoms or an anhydride thereof and an aliphatic polyamine comprising from 2 to 10 nitrogen atoms and from 0 to 2 hydroxyl groups exhibiting a primary or secondary amino group.

2. The method according to claim 1, wherein the saturated or unsaturated aliphatic mono- or polycarboxylic acid comprises a saturated or unsaturated aliphatic monocarboxylic acid having from 14 to 200 carbon atoms.

3. The method according to claim 2, wherein the saturated or unsaturated aliphatic mono- or polycarboxylic acid comprises oleic acid.

4. The method according to claim 1, wherein the aliphatic polyamine comprises a polyalkyleneamine of formula:

$H_2N\text{-}(A\text{-}NH)_n\text{—}H$, wherein n is a number of from 1 to 5 and A represents 1,2-ethylene, 1,3-propylene, 1,2-propylene, or 1,4-butylene.

5. The method according to claim 1, comprising:

reacting the saturated or unsaturated aliphatic mono- or polycarboxylic acid and the aliphatic polyamine in a molar ratio of from 1.1:1 to 7:1, wherein the aliphatic polyamine exhibits at least two amino groups which are primary or secondary amino groups.

6. The method according to claim 1, wherein the first additive having detergent activity is selected from the group consisting of:

(i) a compound having a moiety derived from succinic anhydride and having a hydroxyl group, an amino group, an amido group, an imido group, or a combination thereof;

(ii) a nitrogen compound quaternized in a presence of an acid or in an acid-free manner, obtained by introducing a compound comprising an oxygen- or nitrogen-containing group reactive with an anhydride and additionally a quaternizable amino group onto a polycarboxylic anhydride compound and subsequently by quaterinizing thereof; and (iii) a polytetrahydrobenzoxazine and a bistetrahydrobenzoxazine.

7. The method according to claim 1, wherein the fuel oil further comprises, as a second additive, at least one dehazer selected from the group consisting of:

(iv) an alkoxylation copolymer comprising units obtained from ethylene oxide, propylene oxide, butylene oxide, styrene oxide, other epoxy-containing monomers, or a combination thereof; and (v) an alkoxylated phenol formaldehyde resin.

8. The method according to claim 1, wherein the fuel oil further comprises, as a third additive, a cetane number improver.

9. The method according to claim 1, wherein the fuel oil further comprises:

(a) from 0.1 to 100% by weight of a biofuel oil derived from a fatty acid ester, and (b) from 0 to 99.9% by weight of a middle distillate, wherein the middle distillate is fossil origin, synthetic origin vegetable origin, animal origin, or a combination thereof, which comprises a hydrocarbon mixture and is free of the fatty acid ester.

10. The method according to claim 1, wherein the fuel oil consist exclusively of a middle distillate comprising fossil origin, synthetic origin vegetable origin, animal origin, or a combination thereof, which comprises a hydrocarbon mixture and is free of the fatty acid ester.

11. The method according to claim 1, wherein the fuel oil has a sulfur content of less than 50 mg/kg.

12. The method according to claim 1, wherein the fuel oil has a maximum content of 8% by weight of polycyclic aromatic hydrocarbon.

13. The method according to claim 1, wherein the fuel oil has a 95% distillation point at not more than 360° C.

* * * * *